US008118550B2

(12) United States Patent
Burdgick et al.

(10) Patent No.: US 8,118,550 B2
(45) Date of Patent: Feb. 21, 2012

(54) TURBINE SINGLET NOZZLE ASSEMBLY WITH RADIAL STOP AND NARROW GROOVE

(75) Inventors: Steven Sebastian Burdgick, Schenectady, NY (US); Andrew Paul Greif, Geneva, IL (US); Lyle B. Spiegel, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 539 days.

(21) Appl. No.: 12/402,066

(22) Filed: Mar. 11, 2009

(65) Prior Publication Data

US 2010/0232956 A1 Sep. 16, 2010

(51) Int. Cl.
*F01D 1/02* (2006.01)

(52) U.S. Cl. ..... 415/208.1

(58) Field of Classification Search ..... 415/208.1, 415/208.2, 208.3, 208.4, 209.1, 209.2, 209.3, 415/209.4, 210.1
See application file for complete search history.

(56) References Cited

U.S. PATENT DOCUMENTS

| | | | | |
|---|---|---|---|---|
| 4,684,320 | A * | 8/1987 | Kunz | 415/190 |
| 5,848,854 | A * | 12/1998 | Brackett | 403/327 |
| 6,354,797 | B1 | 3/2002 | Heyward et al. | |
| 6,932,568 | B2 | 8/2005 | Powis et al. | |
| 7,427,187 | B2 | 9/2008 | Burdgick et al. | |
| 7,470,109 | B2 | 12/2008 | Tomko et al. | |
| 2004/0141839 | A1 * | 7/2004 | Weaver | 415/210.1 |
| 2004/0219014 | A1 * | 11/2004 | Synnott | 415/209.2 |
| 2005/0111973 | A1 * | 5/2005 | Sullivan et al. | 415/209.2 |
| 2007/0086892 | A1 | 4/2007 | Tomko et al. | |
| 2007/0183891 | A1 * | 8/2007 | Evans et al. | 415/208.1 |
| 2007/0292266 | A1 * | 12/2007 | Burdgick et al. | 415/191 |
| 2008/0019836 | A1 * | 1/2008 | Butz et al. | 416/190 |
| 2008/0193289 | A1 * | 8/2008 | Khanin et al. | 415/209.2 |
| 2011/0200430 | A1 * | 8/2011 | Burdgick et al. | 415/209.3 |
| 2011/0211946 | A1 * | 9/2011 | Burdgick et al. | 415/209.3 |

OTHER PUBLICATIONS

Paumen, U.S. Appl. No. 12/402,081, Notice of Allowance and Fees Due, 233342-1, Oct. 18, 2011, 8 pages.

* cited by examiner

*Primary Examiner* — Ross Gushi
(74) *Attorney, Agent, or Firm* — Hoffman Warnick LLC

(57) ABSTRACT

A nozzle assembly for a turbine including an airfoil, inner and outer sidewalls, and inner and outer rings is provided. The sidewalls and rings are coupled together using a weld and mechanical interconnection, including axial and radial mechanical stops to allow for an accurate assembly, to ensure correct radial and axial positions of the parts during welding, to minimize weld shrinkage and to control an axial weld length. The configuration may further include one or more surfaces at an interface between a ring and a sidewall angled away from the interface to form a narrow groove. The configuration further may include a ring with a consumable root portion to facilitate the weld, and to provide a fixturing stop to further ensure that the parts remain in the correct position.

20 Claims, 4 Drawing Sheets

TURBINE SINGLET NOZZLE ASSEMBLY WITH RADIAL STOP AND NARROW GROOVE

CROSS REFERENCE TO RELATED APPLICATIONS

This patent application relates to commonly-assigned U.S. patent application Ser. No. 12/402,081 entitled "TURBINE SINGLET NOZZLE ASSEMBLY WITH MECHANICAL AND WELD FABRICATION", filed concurrently with this application.

FIELD OF THE INVENTION

The invention relates generally to turbine technology. More particularly, the invention relates to a turbine singlet nozzle assembly design with a radial stop and a narrow groove for weld preparation.

BACKGROUND OF THE INVENTION

Turbines, including gas or steam turbines, include nozzle assemblies that direct a flow of steam or gas into rotating blades that are coupled to a rotating shaft so as to cause the rotating shaft to turn. One configuration for the nozzle assemblies includes a singlet design, including a blade, or airfoil, between inner and outer sidewalls, with the sidewalls coupled to an inner and outer ring, respectively, and with a mechanical axial stop at the interface between the sidewalls and the rings.

Current methods of fabricating these singlet nozzle assemblies require welding the various parts of the nozzle assembly together across the interface of sidewalls and rings. However, certain welding technologies can introduce large amounts of heat, along with significant amounts of weld filler material, that can distort the parts of the singlet nozzle being welded. Therefore, lower heat weld types such as shallow electron beam welds, shallow laser welds are typically used, while higher heat weld types such as gas tungsten arc welds (GTAW) (also known as tungsten inert gas (TIG) welding) and gas metal arc welds (GMAW) (also known as metal inert gas (MIG) welding) are not preferred as they may distort the parts being welded due to the significant weld filler material and/or high heat input.

BRIEF DESCRIPTION OF THE INVENTION

Embodiments of this invention include a nozzle assembly for a turbine, the nozzle assembly including an airfoil, inner and outer sidewalls, and inner and outer rings. The inner ring and inner sidewall (and similarly the outer ring and the outer sidewall) are interconnected, via mechanical elements and welding, at an interface. The interconnection includes axial and radial mechanical stops to allow for an accurate assembly, to ensure correct radial and axial positions of the parts during welding, to minimize weld shrinkage and to control an axial weld length. The configuration may further include one or more surfaces at an interface between a ring and a sidewall angled away from the interface to form a narrow groove. The configuration further may include a ring with a consumable root portion to facilitate the weld, and to provide a fixturing stop to further ensure that the parts remain in the correct position. The configuration further is configured such that the stress concentration on a root of the weld is in a substantially vertical direction.

A first aspect of the disclosure provides a nozzle assembly for a turbine, the nozzle assembly comprising: at least one airfoil having an outer sidewall; an outer ring mechanically coupled to the outer sidewall at an interface; a mechanical axial stop at the interface of the outer sidewall and the outer ring, the mechanical axial stop configured to maintain the at least one airfoil in a correct axial position; and a mechanical radial stop at the interface of the outer sidewall and the outer ring, the mechanical radial stop configured to maintain the at least one airfoil in a correct radial position, wherein at least one of (a) a portion of the outer ring at the interface and (b) a portion of the outer sidewall at the interface, is angled away from the interface to form a narrow groove between the outer ring and the outer sidewall.

A second aspect of the disclosure provides a nozzle assembly for a turbine, the nozzle assembly comprising: at least one airfoil having an inner sidewall; an inner ring mechanically coupled to the inner sidewall at an interface; a mechanical axial stop at the interface of the inner sidewall and the inner ring, the mechanical axial stop configured to maintain the at least one airfoil in a correct axial position; and a mechanical radial stop at the interface of the inner sidewall and the inner ring, the mechanical radial stop configured to maintain the at least one airfoil in a correct radial position, wherein at least one of (a) a portion of the inner ring at the interface and (b) a portion of the inner sidewall at the interface, is angled away from the interface to form a narrow groove between the inner ring and the inner sidewall.

DETAILED DESCRIPTION OF THE INVENTION

Figure 2:
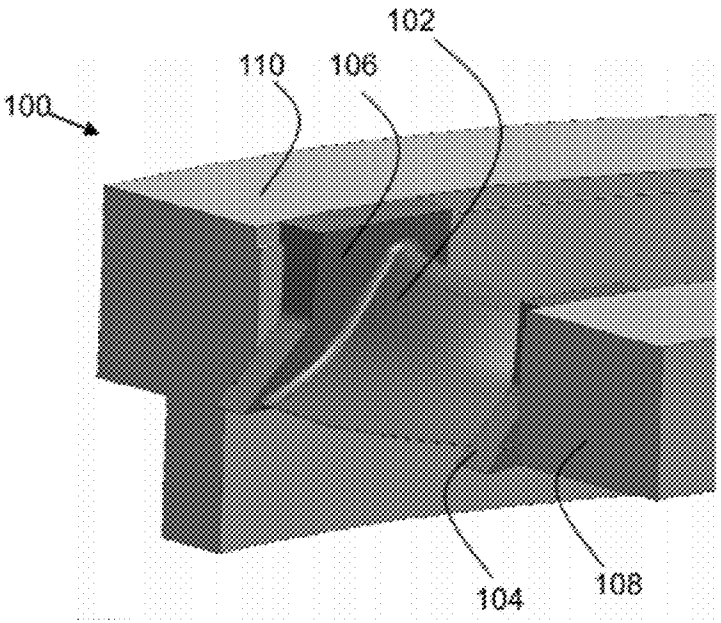
FIG. 2 shows a three-dimensional schematic of a nozzle assembly for a turbine according to embodiments of this invention.
Figure 1:
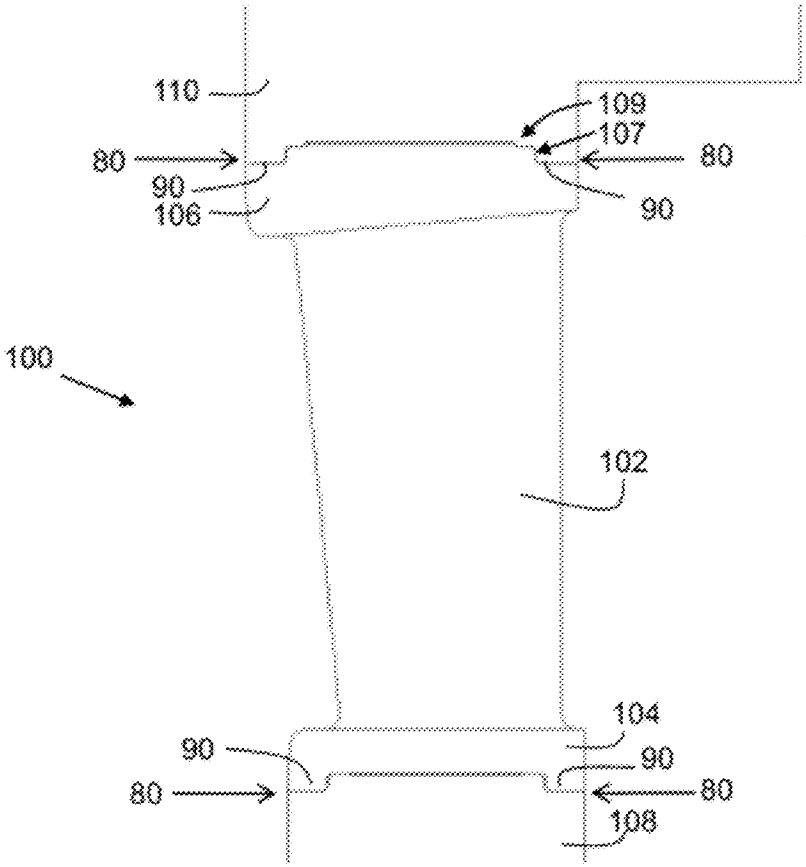
FIG. 1 shows a schematic of a nozzle assembly for a turbine according to embodiments of this invention.

Referring to the drawings, FIG. 1 shows a line drawing schematic of nozzle assembly 100 for a gas or steam turbine (not shown), while FIG. 2 shows a three-dimensional schematic of nozzle assembly 100. Nozzle assembly 100 includes at least one airfoil 102 having an inner sidewall 104 and an outer sidewall 106. Nozzle assembly 100 further includes an inner ring 108 and an outer ring 110. Inner and outer, as used herein, refer to a radial position relative to a rotor (not shown) to which an inner end of airfoil 102 is coupled via inner ring 108. Inner ring 108 and inner sidewall 104 are coupled together, mechanically and by welding, at an interface, and similarly, outer ring 110 and outer sidewall 106 are coupled together, mechanically and by welding, at an interface 80, which is understood to refer to the entire area where rings and sidewalls are adjacent and coupled. Inner ring 108 and inner sidewall 104 (and similarly outer ring 110 and outer sidewall 106) are welded together at several points along interface 80. The multiple welded areas of interfaces 80 that are welded together are shown generally as areas 90 in FIG. 1.

Interfaces 80 between rings 108, 110 and sidewalls 104, 106 each include a mechanical radial stop 109 which maintains blade 102 in the correct radial position during welding and prevents weld shrinkage. Interfaces 80 each further include a mechanical axial stop 107 which maintains blade 102 in the correct axial position and controls the weld length depth. These mechanical stops 107, 109 comprise an interconnection of a series of male steps which engage in corresponding female steps of the complementary part as described in more detail herein. As such, interfaces 80 include both welded areas 90 and mechanical interconnections 107, 109.

Figure 3:
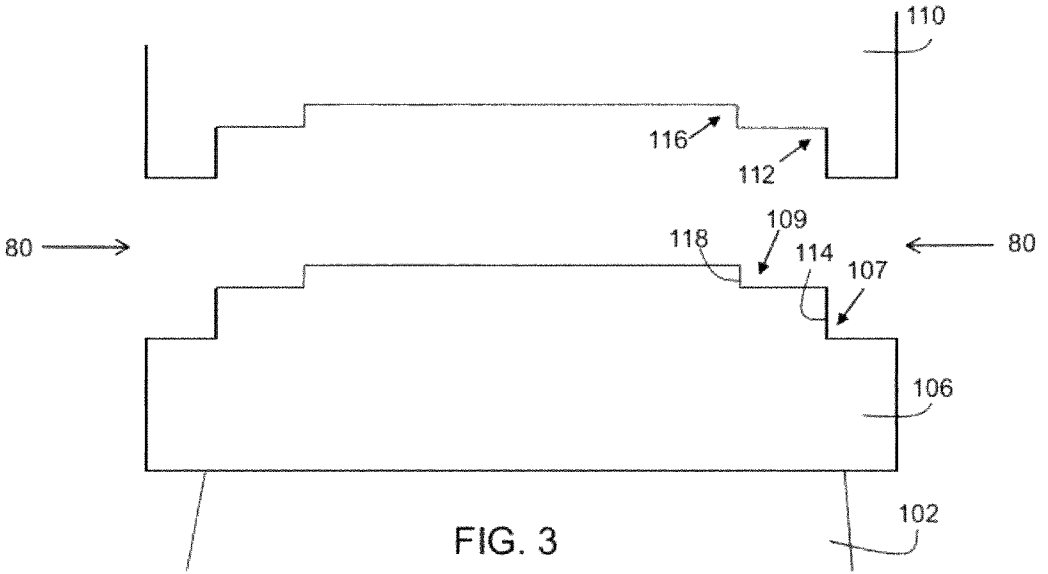
FIGS. 3-5 show exploded cross-sectional views of the interface between a sidewall and a ring of a nozzle assembly according to embodiments of this invention.
Figure 4:
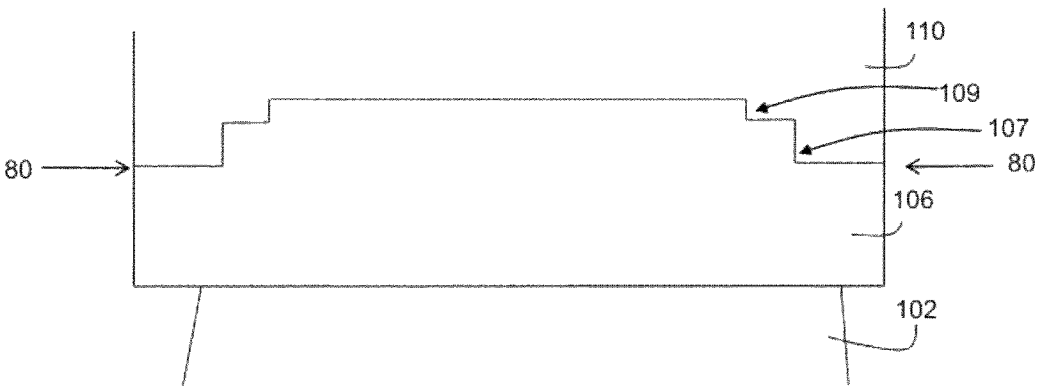

An exploded view of interface 80 between outer ring 110 and outer sidewall 106 is shown in FIGS. 3 and 4. FIG. 3 shows a line drawing of interface 80 of outer ring 110 and outer sidewall 106, exaggerated for purposes of explanation, with outer ring 110 and outer sidewall 106 not yet connected. As shown in FIG. 4, once outer ring 110 and outer sidewall 106 are mated together, interface 80 between sidewall 106 and ring 110 includes mechanical axial and radial stops 107, 109, i.e., an interconnection of a series of male steps which engage in corresponding female steps of the complementary part.

For example, as shown in FIG. 3, mechanical axial stop 107 can be formed by outer ring 110 including a first female step 112 and outer sidewall 106 including a corresponding first male step 114. Mechanical radial stop 109 can be formed by outer ring 110 having a second female step 116, adjacent to first female step 112, and outer sidewall 106 including a corresponding second male step 118, adjacent to first male step 114. FIG. 4 shows an exploded view of interface 80 of outer ring 110 and outer sidewall 106 after coupling, including mechanical radial stop 109 and mechanical radial stop 107.

Figure 5:
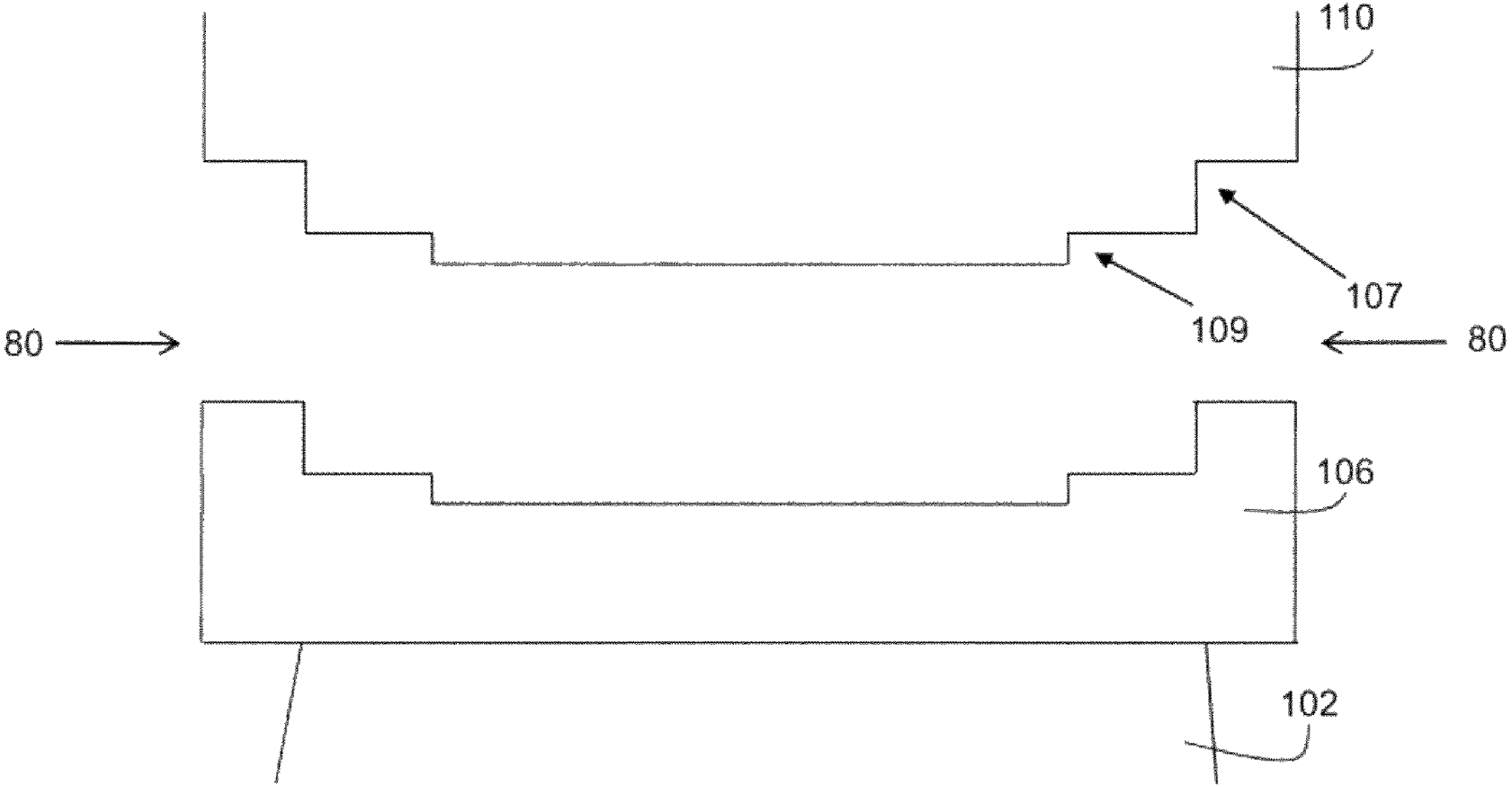

Alternatively, as shown in FIG. 5, mechanical axial stop 107 and mechanical radial stop 109 can be formed by reversing the interconnection of male steps which engage in the female steps of the complementary part. In other words, while it is shown in the other figures that outer sidewall 106 includes central male steps and outer ring 110 is shown with central female steps, the reverse, as shown in FIG. 5, is also disclosed. Outer sidewall 106 may instead include central female steps, while outer ring 110 can include central male steps. It is also noted that while the female and male steps are shown in the two-dimensional figures as substantially horizontal, these parts may also be angled to assist proper placement of the parts of the nozzle assembly.

Figure 6:
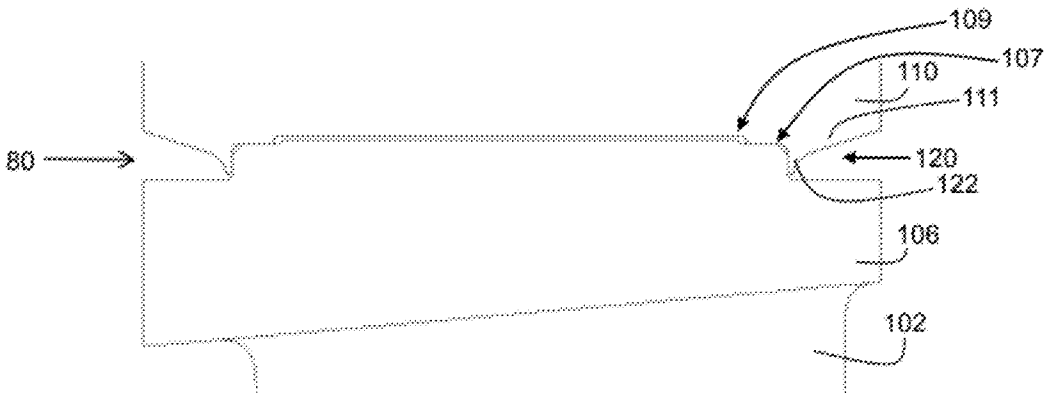
FIGS. 6-7 show exploded cross-sectional views of the interface between a sidewall and a ring of a nozzle assembly according to embodiments of the invention.

Another embodiment of interface 80 between outer sidewall 106 and outer ring 110 of nozzle assembly 100 according to an embodiment of the invention is disclosed in FIG. 6. As shown in FIG. 6, outer sidewall 106 is coupled to outer ring 110 through interface 80 that, as discussed above, includes an interconnection of male steps which engage in the corresponding female steps of the complementary part to provide mechanical axial stop 109 and mechanical radial stop 107. In addition, one or more surfaces at interface 80 can be angled away from the interface to form a narrow groove 120. In the embodiment shown in FIG. 6, a portion of outer ring 110, shown as portion 111, is angled away from interface 80 to form narrow groove 120. Narrow groove 120 can be formed by angling portion 111 of outer ring 110 at an angle in the range of approximately 0° to approximately 11°. While outer ring 110 is shown as having portion 111 angled away from interface 80, outer sidewall 106 could instead have a portion angled away from interface 80.

As also shown in the embodiment shown in FIG. 6, outer ring 110 can further include a protruding consumable root portion 122 that extends toward interface 80 between outer sidewall 106 and outer ring 110. Consumable root portion 122 can include a material having any shape and size suitable for facilitating a weld at interface 80 between outer ring 110 and outer sidewall 106. For example, consumable root portion 122 can include a chamfer, or a square bottom groove. Consumable root portion 122 can act as a consumable root for a weld, such as a TIG weld or can act as a fixturing stop for a weld, such as an electron beam weld (EBW), to ensure that the parts remain in the correct position.

While outer ring 110 and outer sidewall 106 can be welded together using conventional low heat welding techniques, the nozzle assembly of this disclosure also allows for high heat welds, such as GTAW (either using an energized or non-energized filler wire), GMAW or EBW. If a GTAW (also known as TIG) weld is used, a manual TIG weld or fully-automated TIG weld can be used.

Using the configuration of embodiments of this invention, the stress concentration on the root of a weld between outer sidewall 106 and outer ring 110 is in a substantially vertical direction. In addition, the ratio of weld depth to width of the weld is preferably in the range of approximately 3:1 to 10:1.

Figure 7:
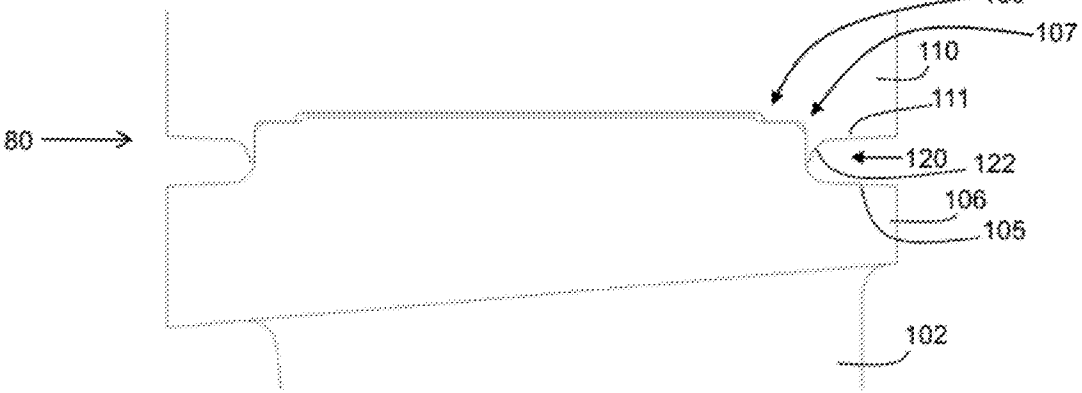

In another embodiment of this invention, shown in FIG. 7, an edge of outer sidewall 106, shown as portion 105, that abuts outer ring 110 is also angled away from interface 80. In contrast to FIG. 6, where only one surface at the ring/sidewall interface was angled away from interface 80, the embodiment shown in FIG. 7 includes both surfaces 105, 111 angled away from interface 80 to form narrow groove 120. Again, portion 105 can be angled away from interface 80 at an angle in the range of approximately 0° to approximately 11°.

It is also noted that while this disclosure discusses embodiments of this invention with respect to outer sidewall 106 and outer ring 110, similar embodiments are disclosed for inner sidewall 104 and inner ring 108. With respect to inner sidewall 104 and inner ring 108, the configuration of male steps which engage in the corresponding female steps of the complementary part can either be identical to those used for outer sidewall 106 and outer ring 110, or can be a mirror image of that configuration.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nozzle assembly for a turbine, the nozzle assembly comprising:

at least one airfoil having an outer sidewall;

an outer ring mechanically coupled to the outer sidewall at an interface;

a mechanical axial stop at the interface of the outer sidewall and the outer ring, the mechanical axial stop configured to maintain the at least one airfoil in a correct axial position; and a mechanical radial stop at the interface of the outer sidewall and the outer ring, the mechanical radial stop configured to maintain the at least one airfoil in a correct radial position, wherein at least one of (a) a portion of the outer ring at the interface and (b) a portion of the outer sidewall at the interface, is angled away from the interface to form a narrow groove between the outer ring and the outer sidewall, and wherein at least a portion of the interface includes a weld between a portion of the outer ring and a portion of the outer sidewall.

2. The nozzle assembly of claim 1, wherein the outer ring further includes a protruding consumable root portion that extends toward the interface of the outer sidewall and the outer ring.

3. The nozzle assembly of claim 1, wherein the portion of the outer ring or the portion of the outer sidewall at the interface is angled away from the interface at an angle in the range of approximately 0° to approximately 11°.

4. The nozzle assembly of claim 1, wherein the mechanical axial stop includes:

(a) the outer ring having a first female step and the outer sidewall having a corresponding first male step, or (b) the outer sidewall having a first female step and the outer ring having a corresponding first male step, and wherein the mechanical axial stop enables interlocking engagement between the outer ring and the outer sidewall.

5. The nozzle assembly of claim 4, wherein the mechanical radial stop includes:

(a) the outer ring having a second female step, adjacent to the first female step, and the outer sidewall having a corresponding second male step, adjacent to the first male step, or (b) the outer sidewall having a second female step, adjacent to the first female step and the outer ring having a corresponding second male step, adjacent to the first male step; and wherein the mechanical radial stop also enables interlocking engagement between the outer ring and the outer sidewall.

6. The nozzle assembly of claim 1, wherein both the portion of the outer ring at the interface and the portion of the outer sidewall at the interface are angled away from the interface.

7. The nozzle assembly of claim 6, wherein the portion of the outer ring at the interface and the portion of the outer sidewall at the interface are angled away from the interface at an angle in the range of approximately 0° to approximately 11°.

8. The nozzle assembly of claim 1, wherein the weld at the interface comprises one of the following: a gas tungsten arc weld (GTAW) using an energized filler wire, a GTAW using a non-energized filler wire, a gas metal arc weld (GMAW) or an electron beam weld (EBW).

9. The nozzle assembly of claim 1, wherein a stress concentration on the weld between the outer sidewall and the outer ring is in a substantially vertical direction.

10. The nozzle assembly of claim 1, wherein a ratio of a depth of the weld to a width of the weld is in the range of approximately 3:1 to 10:1.

11. A nozzle assembly for a turbine, the nozzle assembly comprising:

at least one airfoil having an inner sidewall;

an inner ring mechanically coupled to the inner sidewall at an interface;

a mechanical axial stop at the interface of the inner sidewall and the inner ring, the mechanical axial stop configured to maintain the at least one airfoil in a correct axial position; and a mechanical radial stop at the interface of the inner sidewall and the inner ring, the mechanical radial stop configured to maintain the at least one airfoil in a correct radial position, wherein at least one of (a) a portion of the inner ring at the interface and (b) a portion of the inner sidewall at the interface, is angled away from the interface to form a narrow groove between the inner ring and the inner sidewall, and wherein at least a portion of the interface includes a weld between a portion of the inner ring and a portion of the inner sidewall.

12. The nozzle assembly of claim 11, wherein the inner ring further includes a protruding consumable root portion that extends toward the interface of the inner sidewall and the inner ring.

13. The nozzle assembly of claim 11, wherein the portion of the inner ring at the interface or the portion of the inner sidewall at the interface is angled away from the interface at an angle in the range of approximately 0° to approximately 11°.

14. The nozzle assembly of claim 11, wherein the mechanical axial stop includes:

(a) the inner ring having a first female step and the inner sidewall having a corresponding first male step, or (b) the inner sidewall having a first female step and the inner ring having a corresponding first male step, and wherein the mechanical axial stop enables interlocking engagement between the inner ring and the inner sidewall.

15. The nozzle assembly of claim 14, wherein the mechanical radial stop includes:

(a) the inner ring having a second female step, adjacent to the first female step, and the inner sidewall having a corresponding second male step, adjacent to the first male step, or (b) the inner sidewall having a second female step, adjacent to the first female step and the inner ring having a corresponding second male step, adjacent to the first male step; and wherein the mechanical radial stop also enables interlocking engagement between the inner ring and the inner sidewall.

16. The nozzle assembly of claim 11, wherein both the portion of the inner ring at the interface and the portion of the inner sidewall at the interface, are angled away from the interface.

17. The nozzle assembly of claim 16, wherein the portion of the inner ring at the interface and the portion of the inner sidewall at the interface are angled away from the interface at an angle in the range of approximately 0° to approximately 11°.

18. The nozzle assembly of claim 11, wherein the weld at the interface comprises one of the following: a gas tungsten arc weld (GTAW) using an energized filler wire, a GTAW using a non-energized filler wire, a gas metal arc weld (GMAW) or an electron beam weld (EBW).

19. The nozzle assembly of claim 11, wherein a stress concentration on the weld between the inner sidewall and the inner ring is in a substantially vertical direction.

20. The nozzle assembly of claim 11, wherein a ratio of weld a depth of the weld to a width of the weld is in the range of approximately 3:1 to 10:1.

* * * * *

UNITED STATES PATENT AND TRADEMARK OFFICE

CERTIFICATE OF CORRECTION

PATENT NO. : 8,118,550 B2
APPLICATION NO. : 12/402066
DATED : February 21, 2012
INVENTOR(S) : Burdgick et al.

It is certified that error appears in the above-identified patent and that said Letters Patent is hereby corrected as shown below:

Column 8, line 2 - delete the first instance of the word "weld" in line 2.

Signed and Sealed this
Eighth Day of May, 2012

David J. Kappos

David J. Kappos
*Director of the United States Patent and Trademark Office*